US006244141B1

(12) United States Patent
Han

(10) Patent No.: US 6,244,141 B1
(45) Date of Patent: Jun. 12, 2001

(54) FASTENER HOLDING DEVICE

(76) Inventor: Ki Su Han, 2249 Lerona Ave., Rowland Heights, CA (US) 91748

( * ) Notice: Subject to any disclaimer, the term of this patent is extended or adjusted under 35 U.S.C. 154(b) by 0 days.

(21) Appl. No.: 09/247,754

(22) Filed: Feb. 9, 1999

Related U.S. Application Data

(63) Continuation-in-part of application No. 09/131,533, filed on Aug. 10, 1998, now Pat. No. 6,082,233.

(51) Int. Cl.[7] ..... B25B 23/10
(52) U.S. Cl. ..... 81/453; 81/457
(58) Field of Search ..... 81/451–458, 429

(56) References Cited

U.S. PATENT DOCUMENTS

| | | | | |
|---|---|---|---|---|
| 332,438 | * | 12/1885 | Richardson . | |
| 2,235,235 | * | 3/1941 | Price . | |
| 3,244,208 | | 4/1966 | McKenzie | 145/52 |
| 3,707,894 | | 1/1973 | Stillwagon, Jr. | 81/125 |
| 3,739,825 | | 6/1973 | Knox | 145/51 |
| 3,942,405 | | 3/1976 | Wagner | 85/46 |
| 4,140,161 | | 2/1979 | Russo | 145/52 |
| 4,647,260 | | 3/1987 | O'Hara et al. | 408/241 |
| 4,736,658 | | 4/1988 | Jore | 81/451 |
| 4,809,572 | | 3/1989 | Sasaki | 81/429 |
| 5,207,127 | | 5/1993 | Nick | 81/54 |
| 5,309,799 | | 5/1994 | Jore | 81/451 |
| 5,682,800 | | 11/1997 | Jore | 81/429 |
| 5,791,207 | * | 8/1998 | Ahdoot . | |

FOREIGN PATENT DOCUMENTS

| | | | |
|---|---|---|---|
| 1234341 | 5/1986 | (SU) | 81/451 |

* cited by examiner

*Primary Examiner*—D. S. Meislin
(74) *Attorney, Agent, or Firm*—Lee & Hong

(57) ABSTRACT

A fastener holding device is designed for use with power or hand tools. The device securely engages a fastener, such as a screw, and automatically disengages the fastener when the device is pushed against a work surface. The device includes a driving bit assembly which has a socket on one end for holding a driving bit and has a polygonally shaped portion on the other end for mounting in a power drill. The device further includes a retaining member adapted to be placed on the driving bit assembly and a sleeve member adapted to be placed on the retaining member. The position of the sleeve member in relation to the retaining member allows the fastener to be either engaged or disengaged with respect to the driving bit.

9 Claims, 5 Drawing Sheets

FASTENER HOLDING DEVICE

This is a continuation-in-part of U.S. patent application Ser. No. 09/131,533 filed on Aug. 10, 1998, now U.S. Pat. No. 6,082,233, which is fully incorporated herein by reference.

BACKGROUND OF THE INVENTION

1. Field of the Invention

This invention relates to a fastener holding device which holds fasteners, such as screws, securely in contact with a driving bit, and more particularly, to a fastener holding device which automatically disengages the screw and is intended for use with powered and/or manual tools.

2. Description of Related Art

Conventional screw holding and driving devices show various means for holding a screw in position while screwing the screw into a work material, such as wood or drywall. Such screw holding devices do not provide a means for securely holding a screw head against a driving bit to prevent slippage of the bit from the screw head. In addition, some screw holding devices provide an elongated sleeve around the driving bit to hold the screw therein. To use such screw holding devices, an operator must apply substantial pressure on the screwdriver handle to force the screw into a work material. Such pressure can result in a penetration of a screw at an offset angle or an injury to the operator.

In addition, the conventional screw holding device using a sleeve to hold a screw typically uses a magnetized driving bit to prevent the screw from falling out from the sleeve. Such a magnetic driving bit cannot hold the screw substantially perpendicularly with respect to the work material if the screw is sufficiently heavy (e.g., when using a larger screw). Even if the magnetized driving bit can initially hold the screw perpendicularly with respect to the work material, the driving bit has very poor holding power, and as a result the screw can easily tilt to an undesirable angle when uneven force is applied on the head of the screw. Moreover, when non-metal screws are used, such magnetized driving bit cannot be used, since an operator must manually hold the screw, which defeats the purpose of the fastener holding device.

SUMMARY OF THE DISCLOSURE

It is an object of the present invention to provide a fastener holding device which firmly holds various screw types onto a driving bit so that the screws can be driven into a work material at any desired angles. Further object of the present invention is to provide automatic release of the screw when the screw is either fully or partially embedded into a work material.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

According to a first embodiment of the present invention, the fastener holding device operable with a fastener includes a driving bit assembly having first and second ends, a retaining member adapted to be placed on the first end of and in surrounding relation to the driving bit assembly, in which the retaining member has parallely disposed clamps extending from the retaining member for releasably holding the fastener, and a sleeve member configured to be placed on and in surrounding relation to the retaining member. The sleeve member has recesses formed in the body of the sleeve member to retain the clamps. The sleeve member maintains at least one of a first position and a second position relative to the retaining member, wherein the clamps engage the fastener when the sleeve member is at the first position and disengages the fastener when the sleeve member is at the second position. In the preferred embodiment, the first end of the driving bit assembly is a socket configured to receive a driving bit.

According to one aspect of the present invention, the retaining member has a slot at lower end thereof to engage a protrusion inwardly formed on a lower end of the sleeve member to prevent disengagement of the sleeve member from the retaining member. The slot is longitudinally formed on the retaining member to allow the sleeve member to maintain at least one of the first and the second positions in response to the position of the protrusion with respect to the slot.

According to another aspect of the present invention, the sleeve member further includes a window longitudinally formed between the recesses and the protrusion to access the retainer member. In the present invention, the clamps of the retaining member includes a hook formed at an end portion of the clamps for engaging a head portion of the fastener. Each one of the clamps has a tab protruding therefrom. The tab is sized to fit in the recess of the sleeve member. In this regard, the clamps engage the fastener when the sleeve member is at the first position by an inner wall of the sleeve member pushing against the tab and disengage the fastener when the sleeve member is at the second position by placing the tab into the recess.

According to other aspects of the present invention, the fastener holding device has a bearing ring placed in surrounding relation to the driving bit member and placed inside of the retaining member to allow the driving bit member to rotate with respect to the retaining member. The fastener holding device may be used with a motorized apparatus, such as a power drill, connected to the second end of the driving bit assembly to rotate the driving bit assembly.

According to a second embodiment of the present invention, the fastener holding device operable with a fastener includes a driving bit assembly having first and second ends, and a retaining member adapted to be placed on the first end of and in surrounding relation to the driving bit assembly. The retaining member has parallely disposed clamps, clamps having curved end portions and tips. The tips are disposed against a head portion of the screw toward the driving bit. The fastener holding device also includes a sleeve member placed on and in surrounding relation to the driving bit assembly and adjustably coupled to the retaining member. When the curved end portions of the clamps are pressed against a work surface, the clamps are pushed away respect to each other to allow the tips of the clamps to disengage the head portion of the fastener.

According to one aspect of the present invention, the sleeve member has an inner threaded portion and the retaining member has a matching outer threaded portion to adjustably engage the sleeve member by rotating the sleeve member with respect to the retaining member which in turn adjusts the distance between the tips of the retainer member and the driving bit. The curved end portions of the clamps are extending from the retaining member in a Y-shape to disengage the fastener when the curved end portions are pushed against the work surface.

The present invention may be used with a motorized apparatus, such as a power drill, connected to the second end of the driving bit assembly. In this regard, the first end of the driving bit assembly is a socket configured to receive a driving bit.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
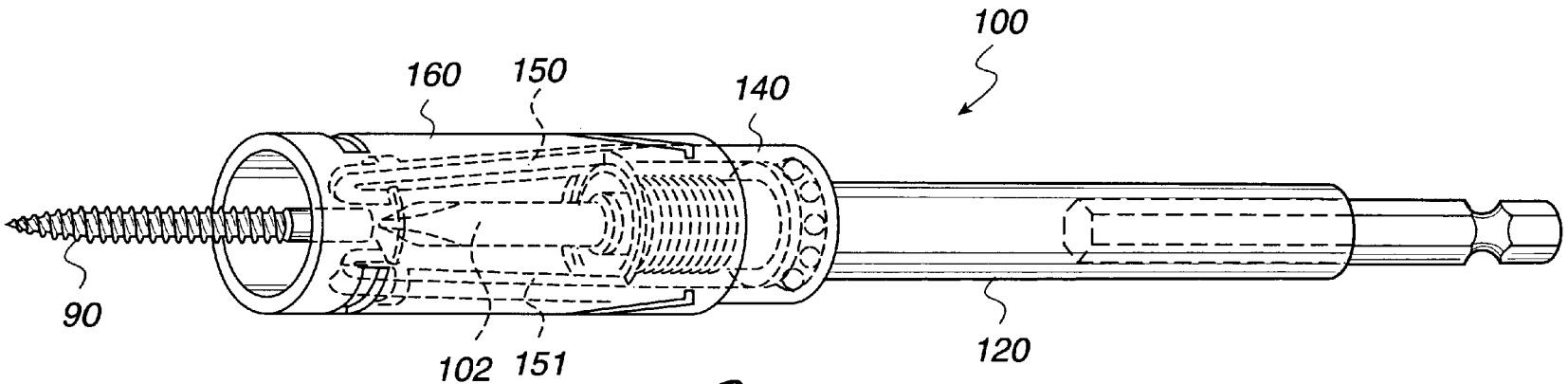
FIG. 1 is a perspective view of a first embodiment of the fastener holding device according to the present invention.

A fastener holding device for holding and driving a fastener, such as a screw, into a work surface according to the embodiments of the invention is shown in the drawings for purposes of illustration. Various embodiments of the fastener holding device are designed to be used with a power tool, but may also be used with hand tools, such as conventional screwdrivers. According to the present invention, the fastener holding device has a driving bit member, a retaining member, a bracing member and a sleeve member. A fastener, such as a screw, is installed in the retaining member in which the head of the screw is securely held against a driving bit by the retaining member so that an operator does not need to manually hold the screw while using the driving tool.

Figure 2:
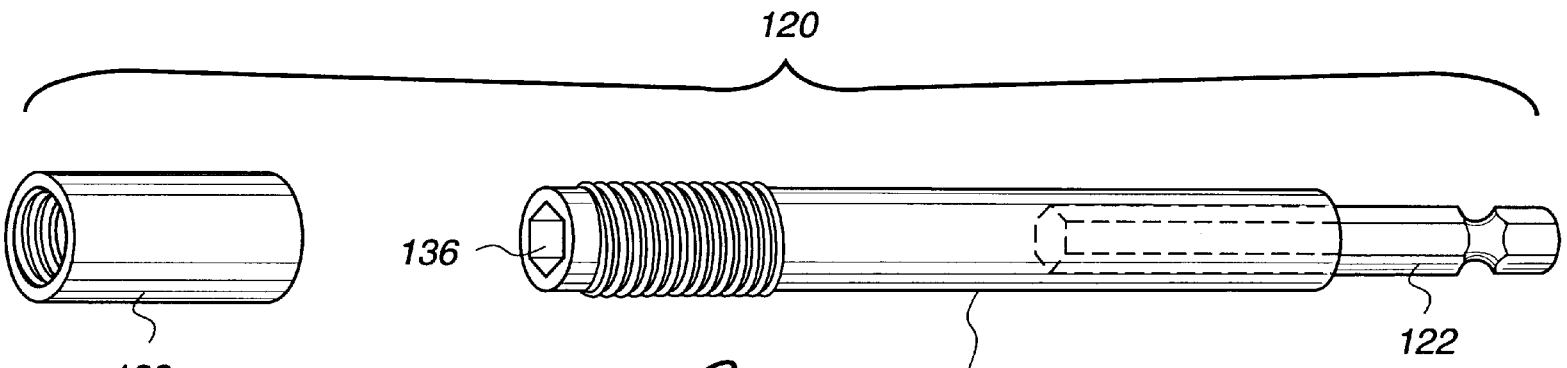
FIG. 2 illustrates a driving bit member of the fastener holding device of FIG. 1.

FIGS. 1–4 illustrate a first embodiment of the fastener holding device 100 which includes a driving bit member 120, a retaining member 140 having an engaging assembly comprising a pair of clamps 150 and 151 and a sleeve member 160. The retaining member 140 is adapted to be fitted on and in surrounding relation with the driving bit member 120. As shown in FIGS. 1 and 2, the driving bit member 120 has an elongated cylindrical first portion 130 which has a cylindrical outer surface and is adapted to be used with a removable driving bit 102. A polygonally shaped elongated second portion 122 is axially connected to the first portion 130. The driving bit member 120 also includes an adjustable sleeve 132 threadably connected to the first portion 130, thus forming the driving bit member 120. In particular, the adjustable sleeve 132 has a threaded inner surface which fits over the externally threaded outer surface of the first portion 130. The adjustable sleeve 132 operates in conjunction with the retaining member 140 to adjust the position of the retaining member 140 with respect to the driving bit coupled to the first portion 130. As such, the screws having various head sizes and thicknesses can be used with the present invention by adjusting the adjustable sleeve 132.

As shown in FIG. 2, the first portion 130 has a polygonally shaped aperture 136 for receiving the driving bit 102 having a similarly constructed external body. The first portion 130 of the driving bit member 120 is adaptable for easily changing screw driver bits having various sizes or head shapes. For example, the aperture 136 of the first portion may be magnetized to firmly hold the driving bit while allowing the user to quickly change the driving bit. In an alternatively embodiment of the present invention, the first portion 130 and the driving bit 102 may be integrated into one component. Similarly, the adjustable sleeve 132 may be formed into a single component with the first portion 130.

As further shown in FIGS. 1 and 2, the second portion 122 of the driving bit member 120 is of a polygonal shape around its circumferential surface and is adapted to be used with power or hand tools. According to the present invention, the first and second portions 130 and 122 of the driving bit member 120 may be formed together as one mold or may be formed as separate portions and coupled together by welding or the like. The driving bit member 120 may be made of any rigid material known to one of ordinary skill in the art, preferably tempered steel or metal.

Figure 3:
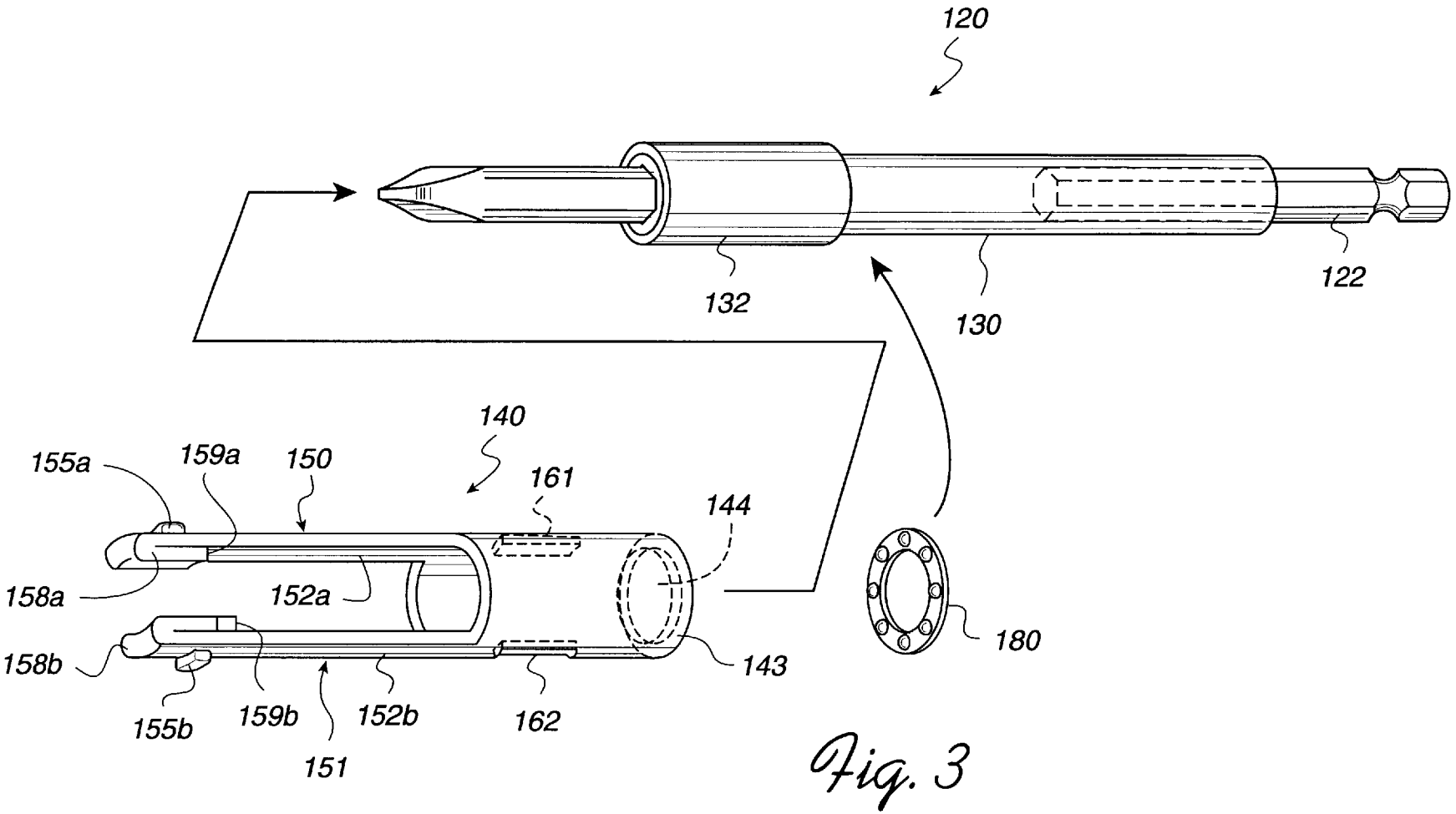
FIG. 3 illustrates a retaining member and a driving bit member of FIG. 1.

FIG. 3 illustrates a retaining member 140, which is configured to be placed on and in surrounding relation to the adjustable sleeve 132, and the first portion 130 of the driving bit member 120. The retaining member 140 is preferably an elongated cylinder with a hollow interior. The retaining member 140 includes a collar 143 formed inwardly around one end of the retaining member 140 to define an end aperture 144 sized and configured to slidably receive and fit around the first portion 130 of the driving bit member 120. Projecting from the other end of the retaining member 140 are a pair of clamps 150 and 151 used for holding a fastener. The first clamp 150 is identical in shape as the second clamp 751. Therefore, the description of the second clamp 151 is identical to the first clamp 150 and is not repeated.

The clamps 150 and 151 together form an engaging assembly of the fastener holding device 100 according to the first embodiment of the present invention. The first clamp 150 has a leg 152*a* extending from the retaining member 140, a hook 158*a* for holding the fastener. The hook 158*a* is preferably formed by folding the end portion of the leg 152*a* inwardly so that a tip 159*a* of the leg 152*a* engages against the bottom surface of the screw head to hold the screw against the driver bit 102. On the body of the retaining member 740, there are two opposite facing rectangular slots 161 and 162 for engaging the sleeve member 160.

Figure 4:
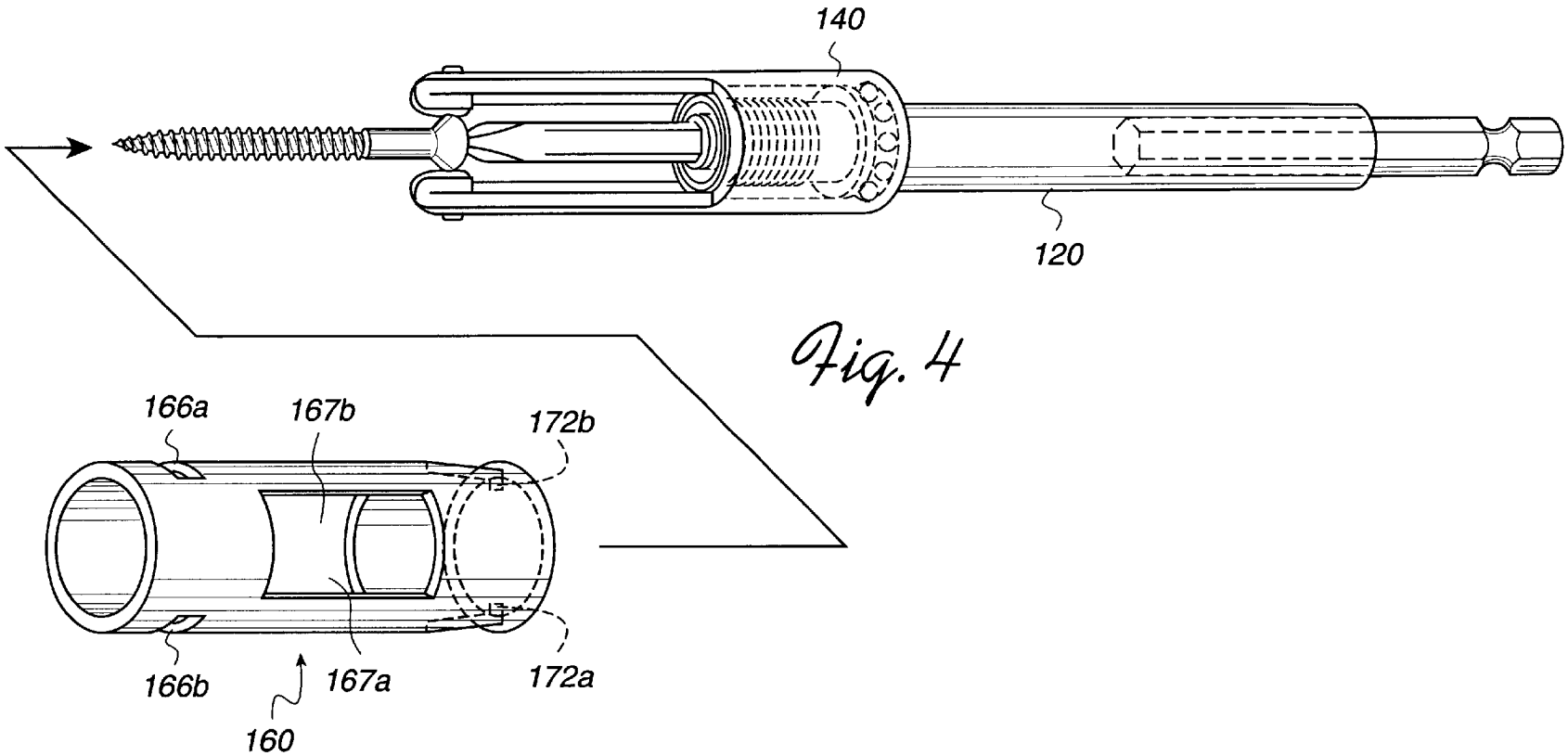
FIG. 4 illustrates the assembly of a sleeve member with the retaining member of FIG. 1.

On the opposite side of the tip 159*a*, there is provide a tab 155*a* projecting substantially perpendicularly from the leg 152*a*. The tab 155*a* is sized to fit in the recess 166*a* of the sleeve member 160, as shown in FIG. 4. The detailed description of the tab 155*a* and the recess 166*a* is described below. In the preferred embodiment, the legs 152*a* and 152*b* are flexible to allow the clamps 150 and 151 to pivot with respect to each other. The retaining member 140 is preferably made with a rigid and durable material, such as plastic or steel.

The retaining member 140 is installed on the driving bit member 120 by inserting the second portion 122 of the driving bit member 120 pass the legs 150 and 152 and through the aperture 144 of the retaining member 140. Prior to such assembly, a bearing ring 180 having a plurality of ball bearings in a washer is placed on the driving bit member 120 and is placed against the bottom surface of the adjustable sleeve 132. In effect, the bearing ring 180 is placed between the adjustable sleeve 132 and the collar 143 of the retaining member 140 to allow the retaining member 140 to rotate with respect to the driving bit member 120. As an alternative to the bearing ring 180, a plurality of ball bearings may be used without the washer or a lubricating material may be substituted.

FIG. 4 illustrates an assembled representation of the retaining member 140 and the driving bit member 120. FIG. 4 further illustrates a sleeve member 160 configured to be placed on and in surrounding relation to the retaining member 140. The sleeve member 160 is an elongated cylinder with a hollow interior with openings on each end of the cylinder. The sleeve member's 160 inner diameter is slightly larger than the outer diameter of the retaining member 140 for sliding in relation to the retaining member 140. The sleeve member 160 has a pair of recesses 166*a* and 166*b* formed on opposite surfaces of the sleeve member 160 for receiving the tabs 155*a* and 155*b*, respectively. The sleeve member 160 also has a pair of opposite facing windows 167*a* and 167*b* to allow a user to access the retaining member 140 for purpose of adjusting the driver bit 102. The sleeve member 160 further includes two opposite facing inward protrusions 172*a* and 172*b* for engaging the slots 161 and 162 of the retaining member 140, respectively. The protrusions 172*a* and 172*b* are L-shaped so one segment thereof is placed along the slot 161 to longitudinally move in the slot 161.

The sleeve member 160 is inserted through the driving bit member 120 and on and surrounding relation to the retaining member 140. Once installed, the sleeve member 160 moves longitudinally with respect to the retaining member 140 because the inward protrusions 172*a* and 172*b* of the sleeve member 160 is engaged in the slots 161 and 162 of the retaining member. The width of the slots 161 and 162 are slightly larger than the width of the protrusion 172*b* and 172*b*. The length of the slots 161 and 162 may be of any suitable size and preferably is between ⅛ to ½ inches. The recesses 166*a* and 166*b* of the sleeve member 160 are sized to fit the tabs 155*a* and 155*b*, respectively, therein.

The operation of the fastener holding device 100 according to the first embodiment will now be discussed. To place a screw onto a driving bit 102, the sleeve member 160 is manually pulled back relative to the retaining member 140. When the sleeve member 160 is sufficiently pulled backward with respect to the retaining member 140, the tabs 155*a* and 155*b* of the clamps 150 and 151 are inserted into the recesses 166*a* and 166*b*, respectively, thus flexing the clamps 150 and 152 outward to receive a fastener, such as a screw. A screw 90 is then placed against the driving bit 102. Depending on the thickness of the screw head, the position of the driving bit 102 with respect to the retaining member 140 is adjusted by rotating the adjustable sleeve 132 with respect to the first portion 130 of the driving bit member 120.

By pulling the sleeve member 160 forward with respect to the retaining member 140, the clamps 150 and 152 are pushed toward each other by the force of the tabs 155*a* and 155*b* pressed against the inner surface of the sleeve member 160. In this regard, the tips 159*a* and 159*b* of the clamps 150 and 751 engage the head portion of the screw, as shown in FIG. 1. Because the sleeve member 160 surrounds the clamps 150 and 151 through the tabs 155*a* and 155*b*, the clamps 150 and 151 can no longer be flexed outwardly, thus firmly holding the screw against the driving bit 102. The screw is now ready to be driven into a work surface, as shown in FIG. 1.

As the driving bit member 120 rotates with respect to the sleeve member 160, the sleeve member 160 is pushed against the work surface. The sleeve member 160 then moves toward the rear while the driving bit member 120 and the retaining member 140 is still moving forward. Eventually, the tabs 155*a* and 155*b* are aligned with the recesses 166*a* and 166*b*, thus allowing the clamps 150 and 151 to disengage the screw before the screw is completely embedded in the work surface. The driving bit member 120 continuously rotates until the screw is completely embedded into the work surface. The result is that the fastener holding device 100 according to the present invention firmly holds the screw and automatically disengages the screw after a substantially portion of the screw has been inserted into the work surface.

Figure 5:
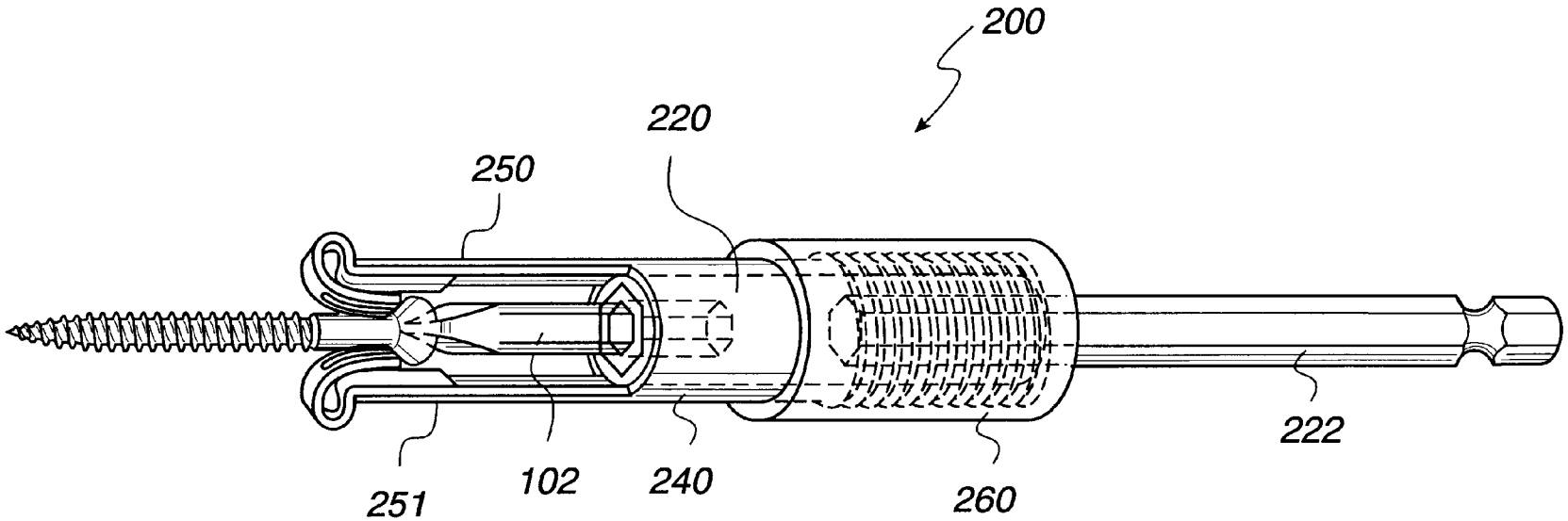
FIG. 5 is a perspective view of a second embodiment of the present invention.
Figure 6:
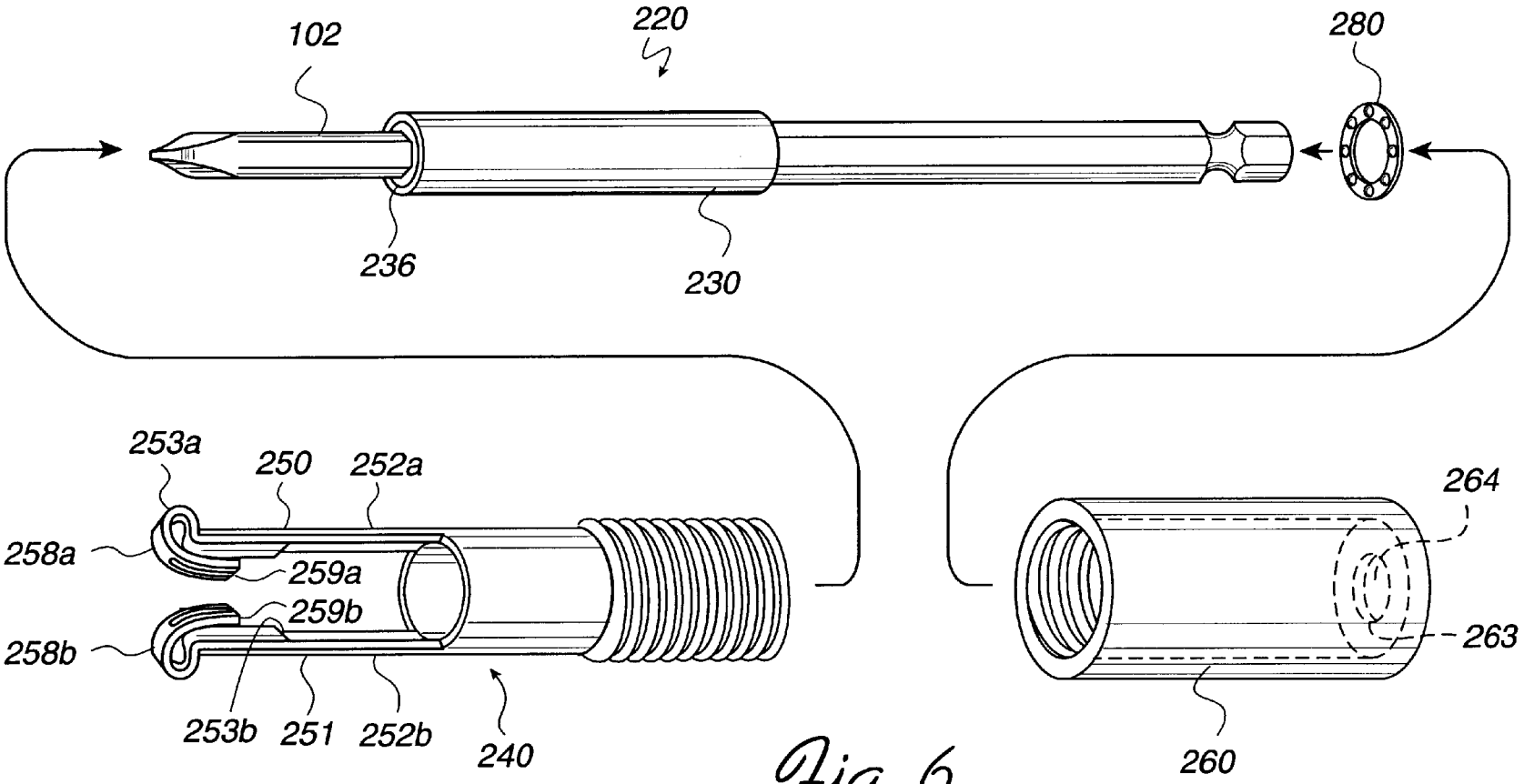
FIG. 6 is an exploded view of the fastener holding device of FIG. 5.

FIG. 5 illustrates a second embodiment of the fastener holding device 200 which includes a driving bit member 220, a retaining member 240 having an engaging assembly comprising a pair of clamps 250 and 251 and an adjustable sleeve member 260. The retaining member 240 is adapted to be fitted with the driving bit member 220. As shown in FIGS. 5 and 6, the driving bit member 220 has an elongated cylindrical first portion 230 which has a cylindrical outer surface and is adapted to be used with a removable driving bit 102. A polygonally shaped elongated second portion 222 is axially connected to the first portion 230. The adjustable sleeve member 260 is threadably connected to the retaining member 240. In particular, the adjustable sleeve member 260 has a threaded inner surface which fits over the externally threaded outer surface of the retaining member 240. The adjustable sleeve member 260 operates in conjunction with the retaining member 240 to adjust the position of the retaining member 140 with respect to the driving bit 102 coupled to the first portion 230 of the driving bit member 220. As such, screws having various head sizes and thicknesses can be used with the present invention by adjusting the adjustable sleeve member 260.

As shown in FIG. 6, the first portion 230 of the driving bit member 220 has a polygonally shaped aperture 236 for receiving the driving bit 102 having a similarly constructed external body. The first portion 230 of the driving bit member 220 is adaptable for easily changing screw driver bits having various sizes or head shapes. In an alternatively embodiment of the present invention, the first portion 230 and the driving bit 202 may be integrated into one component. Similarly, the second portion 222 may be formed into a single component with the first portion 230.

The second portion 222 of the driving bit member 120 is of a polygonal shape around its circumferential surface and is adapted to be used with power or hand tools. According to the present invention, the first 230 and second portions 222 of the driving bit member 220 may be formed together as one mold or may be formed as separate portions and coupled together by welding or the like. The driving bit member 220 may be made of any rigid material known to one of ordinary skill in the art, preferably tempered steel or metal.

The adjustable sleeve member 260 includes a collar 263 formed inwardly around one end of the adjustable sleeve member 260 to define an end aperture 264 sized and configured to slidably receive and fit around the second portion 222 of the driving bit member 220 without restricting the rotating movement of the driving bit member 220.

FIG. 6 also illustrates a retaining member 240, which is configured to be placed on and in surrounding relation to the driving bit member 220 and to be coupled with the adjustable sleeve member 260. The retaining member 240 is preferably an elongated cylinder with a hollow interior.

Projecting from the one end of the retaining member 140, opposite of the threaded end, are a pair of clamps 250 and 251 used for holding a fastener. The first clamp 250 is identical in shape as the second clamp 251.

The clamps 250 and 251 together form an engaging assembly of the fastener holding device 200 according to the second embodiment of the present invention. The first clamp 250 has a leg 252*a* extending from the retaining member 240, a hook 258*a* for holding the fastener. The hook 258*a* is preferably formed by folding the end portion of the leg 252*a* inwardly so that a tip 259*a* of the leg 252*a* engages against the bottom surface of the screw head to hold the screw against the driver bit 102.

The hooks 258*a* and 258*b* are formed in a spreading or Y-shaped position so that when the hooks are pushed against any surface, the legs 252*a* and 252*b* are pushed away from each other, thus disengaging the screw head held by the tips 259*a* and 259*b*. Between the tip 259*a* and the leg 252*a*, there is provided a wedge 253*a* to further support the screw placed on the driving bit. The wedges 253*a* and 253*b* are preferably placed to reduce the separation distance between the tips 259*a* and 259*b* when smaller screws are used. In the preferred embodiment, the legs 252*a* and 252*b* are formed of a flexible, yet rigid, material so that the clamps 250 and 251 pivot with respect to each other. The retaining member 240, including the legs 250 and 251, is preferably made with a rigid and durable material, such as plastic or steel, known to one of ordinary skill in the art.

The retaining member 240 is installed on the driving bit member 220 by inserting the first portion 130 of the driving bit member 120 through the threaded end of the retaining member 240 and pass the legs 250 and 252.

FIG. 5 illustrates an assembled representation of the retaining member 240 and the driving bit member 220. FIG. 5 further illustrates the adjustable sleeve member 260 configured to be placed on and in surrounding relation to the driving bit member 220 and coupled to the retaining member 240. The sleeve member 260 is an elongated cylinder with a hollow interior with openings on each end of the cylinder. The aperture 264 of the sleeve member's 260 inner diameter is larger than the outer diameter of the second portion 222 of the driving bit member 220 for sliding in relation to the driving bit member 220. The sleeve member's inner diameter is slightly larger than the outer diameter of the retaining member 240 to allow the internally threaded surface of the sleeve member 260 to be coupled with the outer threaded portion of the retaining member 240. Once installed, the sleeve member 260 moves longitudinally with respect to the driving bit member 240.

A bearing ring 280 having a plurality of ball bearings in a washer is inserted on the driving bit member 220 and is placed against the bottom surface of the first portion 230. In effect, the bearing ring 280 is placed between the first portion 230 and the collar 263 of the adjustable sleeve member 260 to allow the retaining member 240 and the sleeve member 260 to rotate with respect to the driving bit member 220. As an alternative to the bearing ring 280, a plurality of ball bearings may be used with out the washer.

The operation of the fastener holding device 200 according to the second embodiment will now be discussed. To place a screw onto a driving bit 102, the head portion of the screw is pushed against the hooks 258*a* and 258*b* of the retaining member 240. Due to flexible nature of the legs 250 and 251, the pressure against the hooks 258*a* and 258*b* move the legs outwardly, thus allowing the screw head to be placed against the driving bit 102. Depending on the thickness of the screw head, the position of the driving bit 102 with respect to the retaining member 240 is adjusted by rotating the adjustable sleeve member 260 with respect to the retaining member 240. The screw is now ready to be applied against a work surface.

As the driving bit member 220 rotates with respect to the retaining member 240, the hooks 258*a* and 258*b* of the retaining member 240 are pushed against the work surface. The shape of the hooks 258*a* and 258*b* allows the legs 250 and 251 to spread open allowing the tips 259*a* and 259*b* to disengage the screw while the driving bit member 220 is still moving forward. The clamps 250 and 251 disengage the screw before the screw is completely embedded in the work surface. The driving bit member 220 continuously rotates until the screw is completely embedded into the work surface. The result is that the fastener holding device 200 according to the present invention firmly hold the screw and automatically disengages the screw after a substantial portion of the screw is inserted into the work surface.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A fastener holding device operable with a fastener, the fastener holding device comprising;

a driving bit assembly having first and second ends;

a retaining member adapted to be placed on the first end of and in surrounding relation to the driving bit assembly, the retaining member having flexible clamps extending from the retaining member for releasably holding the fastener, the clamps maintaining closed and open positions, wherein the retaining member has opposite slots at lower end thereof and each one of the clamps has an outwardly protruding tab; and a sleeve member configured to be placed on and in surrounding relation to the retaining member, the sleeve member having oppositely positioned recesses formed in a body of the sleeve member, each recess being configured to receive the corresponding tab of each clamp; and oppositely positioned L-shaped protrusions inwardly extending toward the center of the sleeve member to engage corresponding slots of the retaining member to prevent disengagement of the sleeve member from the retaining member, wherein each slot of the retaining member allows the sleeve member to maintain at least one of the first and the second positions in response to the position of the protrusion with respect to the slot, wherein the clamps engage the fastener when the sleeve member is at the first position by an inner surface of the sleeve member pushing against the tabs of the clamps and disengage the fastener when the sleeve member is at the second position as the tabs of the clamps are inserted into corresponding recesses.

2. The fastener holding device according to claim 1, wherein the first end of the driving bit assembly is a socket configured to receive a driving bit.

3. The fastener holding device according to claim 1, wherein the sleeve member further includes a window longitudinal formed between the recesses and the protrusion to access the retainer member.

4. The fastener holding device according to claim 1, wherein the clamps of the retaining member includes a hook formed at an end portion of the clamps for engaging a head portion of the fastener.

5. The fastener holding device according to claim 1, further comprising a bearing ring placed in surrounding relation to the driving bit member and placed inside of the retaining member to allow the driving bit member to rotate with respect to the retaining member.

6. The fastener holding device according to claim 1, further comprising a motorized apparatus connected to the second end of the driving bit assembly to rotate the driving bit assembly.

7. A fastener holding device operable with a fastener, the fastener holding device comprising;

driving bit assembly means for driving the fastener, the driving bit assembly means having first and second ends, the first end being a socket configured to receive a driving bit;

retaining means for releasably holding the fastener, the retaining means adapted to be placed on the first end of and in surrounding relation to the driving bit assembly, the retaining means having flexible clamps extending from the retaining means for releasably holding the fastener, the clamps maintaining closed and open positions, wherein the retaining means has opposite slots at lower end thereof and each one of the clamps has an outwardly protruding tab; and sleeve means for controlling the release of the fastener, the sleeve means configured to be placed on and in surrounding relation to the retaining member, the sleeve member having oppositely positioned recesses formed in a body of the sleeve means, each recess being configured and sized to receive the corresponding tab of each clamp; and oppositely positioned L-shaped protrusions inwardly extending toward the center of the sleeve means to engage corresponding slots of the retaining means to prevent disengagement of the sleeve means from the retaining means, wherein each slot of the retaining means allows the sleeve means to maintain at least one of the first and the second positions in response to the position of the protrusion with respect to the slot, wherein the clamps engage the fastener when the sleeve means is at the first position by an inner surface of the sleeve means pushing against the tabs of the clamps and disengage the fastener when the sleeve means is at the second position as the tabs of the clamps are inserted into corresponding recesses.

8. The fastener holding device according to claim 7, wherein the sleeve means further includes a window longitudinally formed between the recesses and the protrusion to access the retainer means.

9. The fastener holding device according to claim 7, wherein the clamps of the retaining means includes a hook formed at an end portion of the clamps for engaging a head portion of the fastener.

* * * * *